US005364459A

United States Patent [19]

Senda et al.

[11] Patent Number: 5,364,459

[45] Date of Patent: Nov. 15, 1994

[54] ELECTROLESS PLATING SOLUTION

[75] Inventors: Atsuo Senda; Kazuhiro Morita; Yoshihiko Takano, all of Kyoto, Japan

[73] Assignee: Murata Manufacturing Co., Ltd., Japan

[21] Appl. No.: 208,962

[22] Filed: Mar. 9, 1994

[30] Foreign Application Priority Data

Mar. 12, 1993 [JP] Japan ..... 5-51619

[51] Int. Cl.[5] ..... C23C 18/34; C23C 18/40; C23C 18/44

[52] U.S. Cl. ..... 106/122; 106/1.23; 106/1.24; 106/1.25; 106/1.26; 106/1.27; 106/1.28

[58] Field of Search ..... 106/1.22, 1.23, 1.24, 106/1.25, 1.26, 1.27, 1.28

[56] References Cited

U.S. PATENT DOCUMENTS

| | | | |
|---|---|---|---|
| 4,482,596 | 11/1984 | Gulla et al. | 106/1.23 |
| 5,143,544 | 9/1992 | Iantosca | 106/1.22 |
| 5,160,373 | 11/1992 | Senda et al. | 106/1.27 |
| 5,173,109 | 12/1992 | Iantosca | 106/1.23 |
| 5,306,335 | 4/1994 | Senda et al. | 106/1.22 |

FOREIGN PATENT DOCUMENTS 3-191070 8/1991 Japan .

*Primary Examiner*—Helene Klemanski
*Attorney, Agent, or Firm*—Ostrolenk, Faber, Gerb & Soffen

[57] ABSTRACT

In order to provide an electroless plating solution containing trivalent titanium ions for serving as a reductant which can deposit a plating film in a pH range between a weak acid level and a weak alkaline level with excellent stability, carbonate such as sodium carbonate or potassium carbonate is contained in the electroless plating solution.

8 Claims, No Drawings

ELECTROLESS PLATING SOLUTION

BACKGROUND OF THE INVENTION

1. Field of the Invention

The present invention relates to an electroless plating solution, and more particularly, it relates to an electroless plating solution containing trivalent titanium ions for serving as a reductant.

2. Description of the Background Art

According to electroless plating, it is possible to homogeneously deposit a plating film of an arbitrary thickness not only on a metal base material of a noble metal such as gold or silver, copper or nickel but on a nonconductor base material of ceramic or plastic by supplying catalytic nuclei while employing a reductant such as formaldehyde, borohydride, hypophosphite or hydrazine. Therefore, electroless plating is not only applied to formation of a conductive film such as an electrode for an electronic component, for example, but is widely employed in various industrial fields of electronics, automobiles and the like, since it is possible to provide the as-formed plating film itself with various characteristics such as electrical resistance, magnetism, wear resistance and self lubricity.

In such electroless plating, however, metals which can be reduced and deposited with the aforementioned reductant are restricted to gold, silver, platinum group elements, copper, nickel and cobalt in general, and hence the application range thereof cannot be much enlarged. Phosphorus, boron, tungsten, iron and the like can be deposited by a eutectoid reaction in deposition of the aforementioned metals.

The assignee has proposed in Japanese Patent Application No. 1-328970 (1989) (Japanese Patent Application Laying-Open No. 3-191070 (1992)) a method which can deposit simple substances of antimony, indium, cadmium, lead, arsenic and zinc as well as alloys thereof in addition to the aforementioned gold, silver, platinum group elements, copper, nickel and cobalt, by noting trivalent titanium ions for serving as a reductant contained in an electroless plating solution and employing the same. Thus, it has been made possible to enlarge the range of elements which can be deposited by electroless plating.

However, the plating solution proposed in the aforementioned application has an irritating odor and a problem of safety in operation, since the same is ammonia-alkaline. Further, this plating solution may cause alteration of a portion of the substrate other than the surface to be plated. In addition, the pH value of the plating solution widely fluctuates during plating. Further, it is necessary to set the plating solution at high concentration and temperature levels, in order to improve the deposition rate. Thus, the aforementioned plating solution still has a number of problems to be solved.

SUMMARY OF THE INVENTION

Accordingly, an object of the present invention is to provide an electroless plating solution, which can solve the aforementioned problems.

The present invention is directed to an electroless plating solution containing trivalent titanium ions for serving as a reductant. In order to solve the aforementioned problems, this electroless plating solution contains carbonate. The trivalent titanium ions are preferably provided by titanium (III) chloride, titanium (III) sulfate, titanium (III) iodide, or titanium (III) methansulfonate.

In more concrete terms, the electroless plating solution according to the present invention contains metal salt which provides a metal deposited by plating, a complexing agent (hydroxycarboxylic acid such as citric acid or amino-polycarboxylic acid such as ethylenediaminetetraacetic acid, for example) for forming a complex thereof, and water-soluble salt containing trivalent titanium ions such as a solution of titanate trichloride, for example, as well as carbonate such as sodium carbonate or potassium carbonate. The carbonate such as sodium carbonate or potassium carbonate may be added to the plating solution as such, or sodium hydroxide or potassium hydroxide may alternatively be added to the plating solution so that carbonic acid gas is thereafter blown into the solution for forming the carbonate.

The present invention can be applied to electroless plating for depositing a film of gold, silver, a platinum group element, copper, nickel, cobalt, antimony, indium, cadmium, lead, tin, bismuth, sulfur, arsenic or zinc, or an alloy thereof.

According to the present invention, a base material to be plated is degreased and thereafter acid-cleaned if the same is made of a metal such as copper or nickel or an alloy thereof, so that an oxide film is removed. When a nonconductor base material of ceramic or plastic is plated, on the other hand, the base material is cleaned, etched and thereafter supplied with a catalyst in ordinary treatment, to start plating reaction. When a plating film is deposited on the base material which is supplied with a catalyst, the reaction continues due to the surface of the plating film having catalytic activity. Namely, it is possible to obtain a plating film of an arbitrary thickness by autocatalytic depositing reaction.

The inventive electroless plating solution containing carbonate is not ammonia-alkaline but its pH value can be set in a range between a weak acid level and a weak alkaline level. Therefore, it is possible to reduce a possibility of causing alteration of the substrate to be plated, as well as to avoid the problem of safety in operation.

According to the present invention, further, it is possible to reduce concentration of a plating bath, particularly that of a complexing agent, as compared with an ammonia-alkaline plating bath while reducing the temperature of the plating bath. In addition, it is possible to provide a plating bath which is excellent in safety.

The foregoing and other objects, features, aspects and advantages of the present invention will become more apparent from the following detailed description of the present invention.

DESCRIPTION OF THE PREFERRED EMBODIMENTS (Example 1)

| Plating Bath Composition: | |
|---|---|
| Trisodium Citrate | 0.17 mol/L |
| Ethylenediaminetetraacetic Acid Disodium | 0.10 mol/L |
| Nitrilotriacetic Acid | 0.10 mol/L |
| Stannous Chloride | 0.07 mol/L |
| Lead Chloride | 0.01 mol/L |
| Titanium Trichloride | 0.04 mol/L |

A plating solution having the aforementioned composition was adjusted to pH 7.0 with a 20% sodium carbonate solution and 2% hydrochloric acid, and the bath temperature was set at 50° C. A test piece was prepared by performing electroless nickel plating on an alumina substrate and removing an oxide film by acid cleaning. A plating film of about 2.5 μm was obtained by plating of 60 minutes.

This film was dissolved with acid and its composition was analyzed by plasma emission spectrochemical analysis, whereby it was recognized that this film was a solder film containing Sn and Pb in a ratio of 72:28. This plating film exhibited excellent results in all of denseness, solderability and adhesion to the underlayer substrate.

(Example 2)

| Plating Bath Composition: | |
|---|---|
| Trisodium Citrate | 0.17 mol/L |
| Trisodium Nitrilotriacetate | 0.20 mol/L |
| Indium Sulfate | 0.08 mol/L |
| Titanium (III) Sulfate | 0.02 mol/L |

A plating solution having the aforementioned composition was adjusted to pH 8.0 with a 20% sodium carbonate solution and 2% sulfuric acid, and the bath temperature was set at 60° C. Test pieces were prepared by applying palladium, gold and silver for forming catalytic nuclei onto alumina substrates by a sensitizing activation method and a catalyst accelerator method respectively, to be subjected to plating. Similar indium plating films were deposited on all test pieces by plating of 45 minutes.

A fluorescence X-ray film thickness meter was employed for thickness measurement, whereby all test pieces exhibited thicknesses of about 3 μm.

(Comparative Example 1)

In order to carry out electroless plating of solder with an ammonia-alkaline plating bath in correspondence to Example 1 with a stable plating bath and a certain degree of deposition rate, complex forming agents required the following concentration levels:

| | |
|---|---|
| Trisodium Citrate | 0.34 mol/L |
| Ethylenediaminetetraacetic Acid Disodium | 0.08 mol/L |
| Nitrilotriacetic Acid | 0.20 mol/L |

Further, it was necessary to adjust the plating bath to pH 9.0 to 9.5 with 28% aqueous ammonia and 2% hydrochloric acid, and the bath temperature was 70° to 75° C.

(Comparative Example 2)

In order to carry out electroless plating of indium with an ammonia-alkaline plating bath in correspondence to Example 2 with a stable plating bath and a certain degree of deposition rate, complex forming agents required the following concentration levels:

| | |
|---|---|
| Trisodium Citrate | 0.34 mol/L |
| Nitrilotriacetic Acid | 0.20 mol/L |

Further, it was necessary to adjust the plating bath to pH 10.0 to 10.5 with 28% aqueous ammonia and 2% sulfuric acid while adjusting the bath temperature to 80° C.

In Example 1 or 2, titanium (III) chloride or titanium (III) sulfate may be replaced by titanium (III) iodide or titanium (III) methansulfonate. Further, in Example 1 or 2, potassium carbonate may be used in the place of sodium carbonate.

Although the present invention has been described in detail, it is clearly understood that the same is by way of illustration and example only and is not to be taken by way of limitation, the spirit and scope of the present invention being limited only by the terms of the appended claims.

What is claimed is:

1. In an electroless plating solution, the improvement comprising trivalent titanium ions for serving as a reductant, and carbonate.

2. An electroless plating solution in accordance with claim 1, wherein said trivalent titanium ions are selected from the group consisting of titanium (III) chloride, titanium (III) sulfate, titanium (III) iodide, and titanium (III) methansulfonate.

3. An electroless plating solution in accordance with claim 1, wherein said carbonate is selected from the group consisting of sodium carbonate, potassium carbonate and mixtures thereof.

4. An electroless plating solution, containing:

metal salt providing a metal being deposited by plating;

a complexing agent for forming a complex of said metal;

water-soluble salt containing trivalent titanium ions for serving as a reductant; and carbonate.

5. An electroless plating solution in accordance with claim 4, wherein said metal is selected from the group consisting of gold, silver, platinum group elements, copper, nickel, cobalt, antimony, indium, cadmium, lead, tin, bismuth, sulfur, arsenic and zinc and alloys thereof.

6. An electroless plating solution in accordance with claim 4, wherein said complexing agent is selected from the group consisting of hydroxycarboxylic acid or amino-polycarboxylic acid.

7. An electroless plating solution in accordance with claim 4, wherein said water-soluble salt containing trivalent titanium ions is selected from the group consisting of titanium (III) chloride, titanium (III) sulfate, titanium (III) iodide, and titanium (III) methansulfonate.

8. An electroless plating solution in accordance with claim 4, wherein said carbonate is selected from the group consisting of sodium carbonate, potassium carbonate and mixtures thereof.

* * * * *